US008568496B2

(12) United States Patent
Schmitt

(10) Patent No.: US 8,568,496 B2
(45) Date of Patent: Oct. 29, 2013

(54) GAS GENERATOR FOR GASIFYING SOLID GRANULAR FUELS BY APPLYING PRESSURE

(75) Inventor: Gerhard Schmitt, Schmitten (DE)

(73) Assignee: Lurgi Clean Coal Technology (PTY) Ltd, Bryanston (ZA)

( * ) Notice: Subject to any disclaimer, the term of this patent is extended or adjusted under 35 U.S.C. 154(b) by 697 days.

(21) Appl. No.: 12/682,602

(22) PCT Filed: Aug. 16, 2008

(86) PCT No.: PCT/EP2008/006739

§ 371 (c)(1),
(2), (4) Date: Jun. 11, 2010

(87) PCT Pub. No.: WO2009/049707

PCT Pub. Date: Apr. 23, 2009

(65) Prior Publication Data

US 2010/0284890 A1 Nov. 11, 2010

(30) Foreign Application Priority Data

Oct. 10, 2007 (DE) ..... 10 2007 048 673

(51) Int. Cl.
*C01B 3/02* (2006.01)
*B01J 7/00* (2006.01)

(52) U.S. Cl.
USPC ..... 48/197 R; 48/61; 252/373; 423/648.1

(58) Field of Classification Search
USPC ..... 423/418.2, 648.1; 422/144; 48/197 R, 48/61; 252/373
See application file for complete search history.

(56) References Cited

U.S. PATENT DOCUMENTS 3,454,382 A * 7/1969 Hamilton ..... 48/76

FOREIGN PATENT DOCUMENTS

| | | | |
|---|---|---|---|
| DE | 4037669 | A1 | 6/1992 |
| EA | 001294 | B1 | 12/2000 |
| GB | 2146656 | A * | 4/1985 |
| JP | 2006132584 | | 5/2006 |
| SU | 959632 | A3 | 9/1982 |
| WO | WO 01/51591 | A1 | 7/2001 |

OTHER PUBLICATIONS

Translation of Request of Substantive Examination from Kazakhstan Intellectual Property Rights Committee; May 27, 2011; 3 pages.

* cited by examiner

*Primary Examiner* — Wayne Langel
*Assistant Examiner* — Syed Iqbal
(74) *Attorney, Agent, or Firm* — Jonathan M. D'Silva; MacDonald, Illig, Jones & Britton LLP

(57) ABSTRACT

In a gas generator for gasifying solid granular fuels to obtain combustible gaseous compounds for producing synthesis gas or $H_2$-suitable raw gas, a fluidized bed formed of the fuels moves through a closed reaction vessel with a sluice mounted at the top for continuously introducing the fuels and with a closure mounted below the funnel-shaped constriction of the bottom for discharging the ash formed into an ash sluice, wherein above the funnel-shaped constriction of the bottom a revolving grate is arranged, through which the gasifying medium can be introduced from below into the fluidized bed, and through which the ash formed can be discharged into the ash sluice via the funnel-shaped constriction and an adjoining tubular portion. To achieve a continuous operation of the revolving grate, a bulk-material slide valve is mounted in the tubular portion.

3 Claims, 1 Drawing Sheet

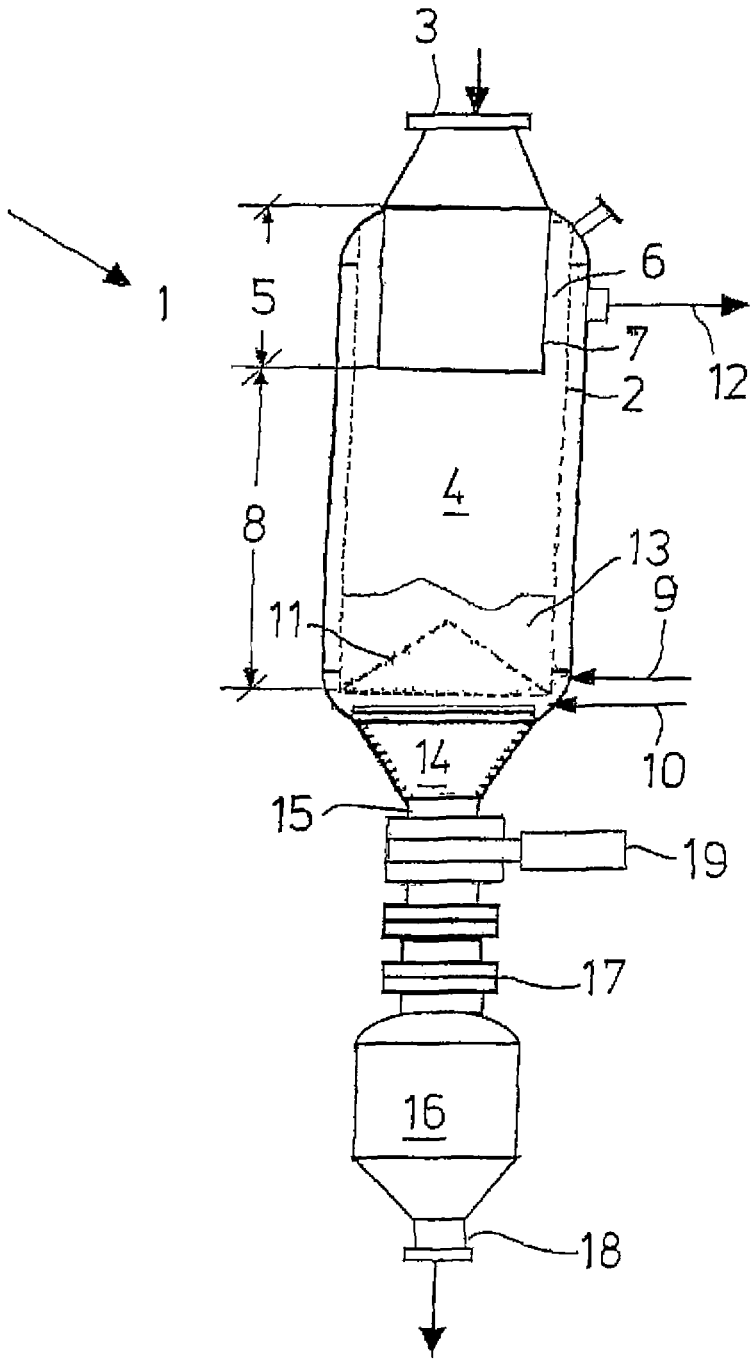
3
1
5
6
7
2
12
4
8
13
9
11
10
14
15
19
17
16
18

GAS GENERATOR FOR GASIFYING SOLID GRANULAR FUELS BY APPLYING PRESSURE

This invention relates to a gas generator for the pressure gasification of solid granular fuels under a pressure of 5 to 100 bar[a] and by heating with a gasifying medium consisting of steam and $O_2$ or steam and air to obtain combustible gaseous compounds for producing synthesis gas or $H_2$-suitable raw gas, comprising a closed reaction vessel with a fluidized bed formed of the fuels, with a sluice mounted at the top for continuously introducing the fuels and a closure mounted below the funnel-shaped constriction of the bottom for discharging the ash formed into an ash sluice, with a revolving grate mounted in the lower portion of the reaction vessel above the funnel-shaped constriction, through which the gasifying medium can be introduced from below into the fluidized bed and through which the ash formed can be discharged via the funnel-shaped constriction and an adjoining tubular portion into the ash sluice. This invention also relates to a method for operating the ash sluice.

The gas generator consists of a closed double-walled vessel which is cooled by evaporation of pressurized water. The solid, granular fuels, such as bituminous coal, lignite, peat, coke, petroleum processing residues, biomass or similar feedstocks with a grain size in the range from 3 to 10 mm, are introduced via a sluice at the top of the gas generator and spread over the cross-section. The gasifying media steam and $O_2$ or steam and air are introduced into the fluidized bed from below through a revolving grate. The introduced fuel slowly travels downwards under the influence of gravity and is dried in counterflow with gas at temperatures below the ash melting point, degasified at temperatures of 300 to 700° C. and gasified at 700 to 1500° C., preferably 1100 to 1500° C., so that finally only ash is left, which is discharged from the revolving grate into the semiautomatically operating ash sluice. The raw gas, which depending on the type of fuel used has a temperature of 300 to 600° C., is discharged from the top of the gas generator and supplied to a processing corresponding to the composition and the intended use. The fuel is continuously introduced into the gas generator through a fully automatically or semiautomatically operating sluice.

In stationary operation of the gas generator, the upper closure of the ash sluice is open. The revolving grate continuously delivers the ash obtained in the lower part of the gas generator into the ash sluice in an amount proportional to the power of the gas generator and to the ash content of the fuels. With a preset filling level of 80% of the ash sluice volume, the ash sluice program starts the ash sluice evacuation cycle. In a first step, the revolving grate is stopped, in order to inhibit the ash flow to the ash sluice. The interruption of the ash flow is important, as the upper ash sluice closure cannot be tightly sealed when the ash flow is interrupted. Only when the upper closure of the ash sluice actually is tightly sealed, is the revolving grate started again. The ash obtained when the ash sluice is closed, is delivered into the space formed by the funnel-shaped constriction and the tubular portion below the revolving grate and is temporarily stored there, until the upper ash sluice closure is opened again and the ash drops into the ash sluice. The tightness of the upper ash sluice closure is absolutely necessary and is checked repeatedly. On average, a tightness test takes three minutes and is repeated in this period, until no more leakage can be detected.

Stopping the revolving grate results in the gas outlet temperature rising continuously. If the temperature of the gas at the outlet of the gas generator exceeds a specified value of >630° C., the gas generator is switched off automatically by closing the valves for gasifying medium, in order to avoid damages such as cracks in the material of the gas generator shell or gas generator outlet port. In the case of fuels with a high ash content, the gas outlet temperature is rising faster than in fuels with a relatively low ash content. Beside the high load of the drive elements, which is caused by stopping and restarting the revolving grate and thereby results in a high material wear, there will furthermore be changes in the position and formation of the oxidation zone of the gas generator. As a result, the admissible gas outlet temperature is exceeded.

It is the object of the present invention to design the gas generator such the ash formed can continuously be discharged from the gas generator, without interrupting the course of the reaction and hence adversely influence the pressure and temperature conditions. In particular, stopping the revolving grate should be omitted, so that the plant components are spared and the material wear is minimized. Furthermore, a constant performance should be maintained in terms of quality and quantity and the time-consuming and production-delaying tightness tests of the upper ash sluice closure should be omitted.

This object is solved by a bulk-material slide valve mounted in the tubular portion, which preferably constitutes a flat slide valve.

The bulk-material slide valve, as it is used in the present invention, is known per se. In U.S. Pat. No. 5,396,919, for instance, a permanent valve is described, which consists of two rotating discs, attached to an axis, and of a pushing/lifting device. By means of rotary movements, the discs are pushed into the opening to be closed. Due to the rotation, a uniform drive of the metal surfaces is achieved, whereby a permanently complete sealing is ensured when the valve is closed.

The bulk-material slide valve in the inventive application for a gas generator interrupts the ash flow to the ash sluice, without the revolving grate having to be stopped. Upon closing the bulk-material slide valve, the ash is continuously introduced into the space between the bottom surface of the revolving grate and the bulk-material slide valve. Directly thereafter, the upper ash sluice closure located below the bulk-material slide valve is closed and subjected to the necessary tightness test, without thereby influencing the pressure gasification. After it is ensured that the upper ash sluice closure is tightly sealed, the ash sluice is relieved to atmospheric pressure, the lower ash sluice closure is opened, and the ash is removed from the ash sluice for further treatment. Directly after closing the upper ash sluice closure, the bulk-material slide valve is opened again. Upon evacuation of the ash sluice, the lower ash sluice closure is again tightly sealed, the ash sluice is strained to the gas generator pressure, and the upper ash sluice closure is opened again. The ash meanwhile accumulated in the space above the upper ash sluice closure drops into the evacuated ash sluice. As soon as the preset filling level is reached, the ash evacuation cycle starts again by closing the bulk-material slide valve.

The advantages of the invention consist in that the revolving grate no longer must be stopped during the ash evacuation cycle. As a result, the gas generation remains uninfluenced by the ash evacuation cycle and can be continued with a constant quality and quantity. Changes in the position and formation of the gas generator oxidation zone, exceeding the maximum admissible gas generator outlet temperature of 630° C., and reductions in power are avoided. Another advantage consists in preventing wear of the revolving grate. Frequent starting and stopping of the revolving grate and high revolving grate starting torques are avoided, whereby the revolving grate drive elements are loaded less and wear of the plant components is minimized. By means of the bulk-material slide valve used in accordance with the invention, a higher operating stability, a constant product quality and an increase in the service life of the revolving grate drive elements thus is achieved.

The invention will subsequently be explained in detail in conjunction with the gas generator schematically illustrated in the drawing.

FIG. 1 shows a longitudinal section through a gas generator with the arrangement of the bulk-material slide valve.

At the top of the gas generator (1), which has a pressurized water evaporation cooling in the double-walled jacket (2), bituminous coal with a grain size of 3 mm to 100 mm and an ash content of 30% is introduced in an amount of about 50,000 kg/h via the feeding sluice (3) and gasified at a pressure of 50 bar[a] and a mean temperature of 1200° C. The bituminous coal spreading over the shaft cross-section of the gas generator (1) forms a fluidized bed (4), which under the influence of gravity slowly moves downwards through a tubular portion (7) arranged in the upper part (5) of the gas generator (1), which forms an annular space (6) with the inside of the double-walled jacket (2), and through the middle and lower part (8). Via conduit (9), $O_2$ is injected into the fluidized bed (4) from below through the revolving grate (1) with a temperature of 110° C. and at a pressure of 34 bar[a], and via conduit (10), steam is injected with a temperature of 400° C. and at a pressure of 40 bar[a], whose mixture forms the gasifying medium. By the counterflowing gasifying medium, the bituminous coal successively is dried, carbonized at a mean temperature of 450° C., gasified at a mean temperature of 950° C. and burnt at a mean temperature of 1150° C. in chronological order. The product gas formed thereby accumulates in the tubular portion (7) between the annular space (6) and the double-walled jacket (2) and is discharged via conduit (12) for further processing. The ash (13) formed is continuously introduced into the ash sluice (16) in an amount of about 8800 kg/h through the revolving grate (11) and via a downwardly constricted funnel-shaped space (14) adjoining below the gas generator (1), which passes into a tubular portion (15). At the top, the ash sluice (16) is defined by the upper ash sluice closure (17) and at the bottom by the lower ash sluice closure (18). Above the upper ash sluice closure (17), the bulk-material slide valve (19) is mounted in the tubular portion (15).

The ash discharged from the gas generator (1) via the revolving grate (11) passes through the downwardly constricted funnel-shaped space (14) and the adjoining tubular portion (15), in which the bulk-material slide valve (19) and the upper ash sluice closure (17) are mounted. The bulk-material slide valve (19) and the upper ash sluice closure (17) are open and the ash continuously drops into the ash sluice (16), which is closed at the bottom by the lower ash sluice closure (18).

When reaching a filling level of 80% of the ash sluice volume, the bulk-material slide valve (19) is closed automatically, so that the ash obtained accumulates above the bulk-material slide valve (19). The revolving grate (11) continues to operate unchanged. Directly after closing the bulk-material slide valve (19), the upper ash sluice closure (17) is closed and its tightness is checked. After a positive test, the ash sluice (16) is relieved to atmospheric pressure, and the bulk-material slide valve (19) and the lower ash sluice closure (18) are opened, so that the ash (13) is discharged from the ash sluice (16).

Upon evacuation of the ash sluice (16), the lower ash sluice closure (18) is closed and its tightness is checked at a pressure of 2 bar[a]. After a positive test, the upper ash sluice closure (17) is opened again, so that the pressure in the ash sluice is increased to operating pressure and the ash (13) accumulated above the upper ash sluice closure (17) can flow into the ash sluice (16).

The invention claimed is:

1. A gas generator (1) for the pressure gasification of solid granular fuels under a pressure of 5 to 100 bar and by heating with a gasifying medium consisting of steam and O2 or steam and air to obtain combustible gaseous compounds for producing synthesis gas or H2-suitable raw gas, comprising a closed reaction vessel with a fluidized bed (4) formed of the fuels, with a feeding sluice (3) mounted at the top for continuously introducing the fuels and a closure (17) mounted below a funnel-shaped constriction (14) of the bottom for discharging the ash (13) formed into an ash sluice (16), with a revolving grate (11) mounted in the lower portion of the reaction vessel above the funnel-shaped constriction, through which the gasifying medium can be introduced from below into the fluidized bed and through which the ash formed can be discharged into the ash sluice via the funnel-shaped constriction and an adjoining tubular portion (15), characterized in that a bulk-material slide valve (19) is mounted in the tubular portion (15).

2. The gas generator according to claim 1, characterized in that the bulk-material slide valve (19) is a flat slide valve.

3. A method for operating the gas generator according to claims 1 and 2, characterized in that the method comprises closing the bulk-material slide valve (19) once the setpoint filling level in the ash sluice (16) has been reached, closing an upper ash sluice closure (17) as soon as the bulk-material slide valve has been closed, allowing the ash present below the bulk-material slide valve (19) to be discharged into the ash sluice (16), opening a lower ash sluice closure (18) and the bulk-material slide valve (19) to allow the ash to be discharged from the ash sluice (16), closing the lower ash sluice closure (18), and opening the upper ash sluice closure (17) to enable the pressure in the ash sluice (16) to increase to operating pressure and to enable ash that has accumulated above the upper ash sluice closure (17) to flow into the ash sluice (16).

* * * * *